United States Patent [19]

Ma

[11] Patent Number: 4,913,011

[45] Date of Patent: Apr. 3, 1990

[54] SELF-ADJUSTABLE RATCHET WRENCH

[76] Inventor: James W. Ma, 98 Fleetwood Dr., Glendale Heights, Ill. 60139

[21] Appl. No.: 213,150

[22] Filed: Jun. 29, 1988

[51] Int. Cl.[4] ..... B25B 13/00

[52] U.S. Cl. ..... 81/90.1; 81/91.1

[58] Field of Search ..... 81/90.10 R, 91.3, 91.1, 81/91.2, 347, 352, 353, 354

[56] References Cited

U.S. PATENT DOCUMENTS

| | | | |
|---|---|---|---|
| 1,924,393 | 8/1933 | Beery | 81/90.1 |
| 2,476,369 | 7/1949 | Gutowski | 81/90.1 |
| 2,706,923 | 4/1955 | Kvaerne | 81/90.1 |
| 3,044,335 | 7/1962 | Keranen | 81/90.1 |
| 3,921,474 | 1/1975 | Dyck et al. | 81/91.2 |
| 4,534,245 | 8/1985 | Rossmann | 81/90.1 |

FOREIGN PATENT DOCUMENTS

| | | | |
|---|---|---|---|
| 0850359 | 9/1970 | Canada | 81/90.1 |
| 0028098 | 7/1884 | Fed. Rep. of Germany | 81/90.1 |
| 0019997 | of 1911 | United Kingdom | 81/90.1 |

*Primary Examiner*—Frederick R. Schmidt
*Assistant Examiner*—Lawrence Cruz
*Attorney, Agent, or Firm*—Fitch, Even, Tabin & Flannery

[57] ABSTRACT

A snap-fit self-adjusting ratchet wrench which has two guided jaws which move linearly against each other along a guided pin, and which are hinged to a handle by pins. The hinges on the jaw to the handle are designed with override leverage wherein the gripping force is increased as the handle is swung in forward stroke and releases in back stroke to provide ratchet action. A return spring exerts force on the jaws for an automatic snapping on the workpiece. A locking mechanism may be provided by a fastening means for retaining the guiding pin to hold the jaw opening to a fixed predetermined position.

2 Claims, 3 Drawing Sheets

SELF-ADJUSTABLE RATCHET WRENCH

The present invention is directed to mechanical hand tools, and, more particularly, is directed to adjustable ratchet wrenches for torquing an object such as a hexagonally shaped screw fastener component.

BACKGROUND OF THE INVENTION

Screw fasteners such as nuts, bolts and screws having a hexagonally shaped torquing component, are important mechanical construction elements. Significant technical effort, over an extended time period, has been devoted to developing mechanisms and devices for manufacturing such screw fasteners. Fixed-size open or closed-ended wrenches, ratcheting socket wrenches which utilize a separate socket for each of a number of standardized sizes of hexagon-shaped screw fasteners, and adjustable wrenches in which the width between parallel jaws may be varied by means of screw mechanism, are examples of conventional wrench designs having widespread use. However, new wrench products which would be easy to use, self-adjustable and self-ratcheting in order that a single wrench may accommodate hexagonally shaped screw fastener components over a continuous range of sizes, would be desirable. Accordingly, it is an aspect of the present invention to provide self-ratcheting wrench products. It is a further aspect to provide such self-ratcheting wrench products which are self-adjustable to accommodate hexagonally shaped screw fastener components over a wide, continuous range of sizes. These and other aspects will now become more apparent from the following detailed description and drawings.

DESCRIPTION OF THE DRAWINGS

FIG. 6 is a cross sectional view through line 6—6 of FIG. 5 illustrating the cam-friction locking mechanism, and.

DESCRIPTION OF THE INVENTION

Figure 1:
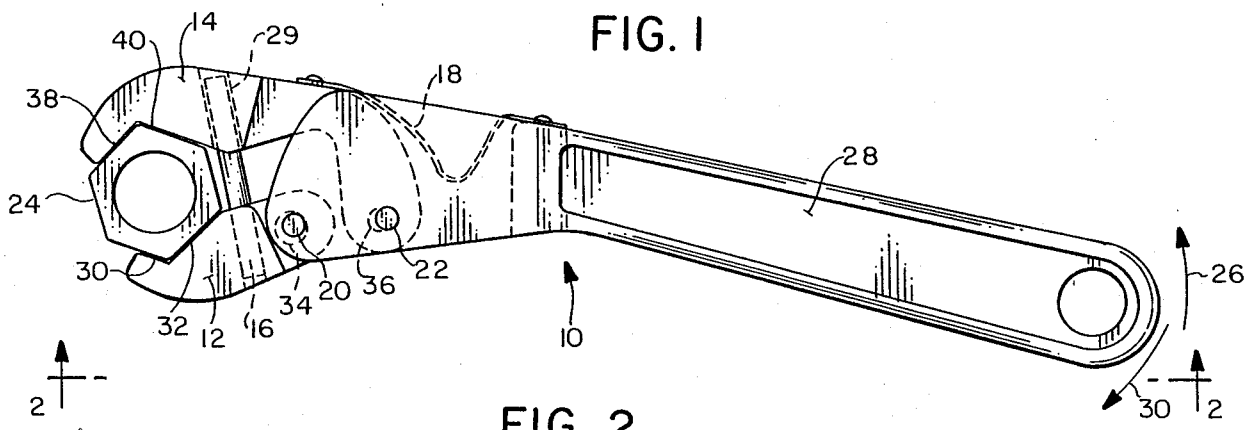
FIG. 1 is an illustration of an alternative embodiment of a self-adjustable, self-ratcheting wrench for torquing hexagonally shaped screw fastener components, having screw compression jaw locking mechanisms and an alternative spring mechanism.

Generally, the present invention is directed to self-adjustable, self-ratcheting wrenches for torquing hexagonally shaped fastener components. Such self-ratcheting, self-adjusting wrenches generally comprise a wrench handle having a distal end for torquing by a wrench user, and a proximal end having a first pivoting means for pivotally receiving a first jaw element and a second pivoting means for pivotally receiving a second jaw element. The wrenches further comprise a first jaw element having a first, flat torquing surface and a second, flat torquing surface forming a substantially 120° angle at the intersection of said first flat torquing surface and said second flat torquing surface, first pivot-engaging and means for engaging said first pivoting means of said handle for axially pivoting the first jaw element about a first axis. The self-adjusting, self-ratcheting wrenches also comprise a second jaw element having a third flat torquing surface and a fourth flat torquing surface forming a substantially 120° angle at the intersection of said third flat torquing surface and said fourth flat torquing surface, and second pivot-engaging means for engaging said second pivoting means for axially pivoting the second jaw element about a second axis which is substantially parallel to said first axis. Wrenches in accordance with the recent invention further comprise means for maintaining said first jaw element and said second jaw element in substantial parallel alignment such that upon relative separation thereof by pivoting of the first jaw element about the said first pivoting means, and concomitant pivoting of the second jaw element about the second pivoting means, the first flat torquing surface of the first jaw element is maintained substantially parallel to the fourth flat torquing surface of the second jaw element and said second flat torquing surface is maintained substantially parallel to said third flat torquing surface to permit engagement of a hexagonally shaped screw fastener therebetween.

In this regard, the first jaw element and the second jaw element are each pivotable about their respective first and second axes of rotation, such that an override leverage may be created by torquing a hexagonally shaped screw fastener element positioned between the first and second jaw element to increase the closing force between the jaw elements when force is applied to the handle in a first rotational direction generally about the wrench torquing axis parallel to the first and second axes, and to decrease the closing force between the jaw element when force is applied to its handle in a second direction generally about the wrench torquing axis opposite to the first direction. To accomplish this result, the first axis and the second axis are positioned on the same side of an action line which is the perpendicular bisector of a line joining the intersection of the first and second surfaces and the intersection of the third and fourth surfaces. The fourth flat torquing surface may desirably be substantially in the plane of said second axis of pivoting. The wrenches will generally further include spring means for exerting a closing force to urge the first jaw element and the second jaw element toward each other.

Having generally described the self-ratcheting, self-adjusting wrenches of the present invention, various aspects of the invention will be described with respect to the specific embodiments illustrated in FIGS. 1–6.

Figure 2:
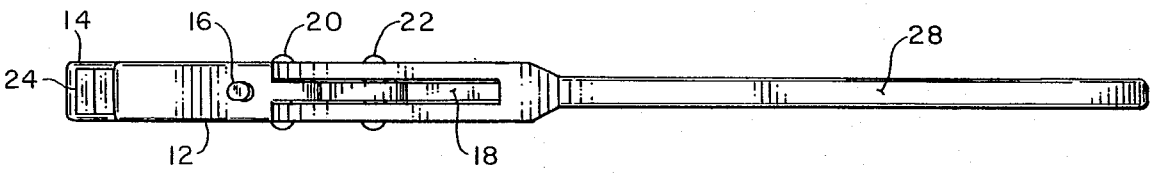
FIG. 2 is a bottom view of the self-adjustable, self-ratcheting wrench of FIG. 1, taken in the direction of line 2—2, in substantial alignment therewith.

In this regard, illustrated in FIGS. 1 and 2 is an embodiment 10 of a self-adjusting, snap-fit wrench for torquing hexagonally shaped screw fastener elements of a wide range of sizes.

The illustrated wrench 10 comprises a pair of jaws 12 and 14, a guiding pin 16, a return spring 18, two pivoting pins 20 and 22 and a handle 28, which are arranged as shown in FIG. 1. The handle 28 has a distal end for torquing by a wrench user, and a proximal end having a first pivoting means 20 for pivotally receiving the first jaw element 12 and a second pivoting means 22 for pivotally receiving a second jaw element 14. The jaw element 12 further includes first pivot-engaging means for engaging the first pivoting means 20 of the handle 28 for axially pivoting the first jaw element 12 about a first axis. The second jaw element has a third flat torquing surface 38 and a fourth flat torquing surface 40 forming a substantially 120° angle at the intersection of the third flat torquing surface 38 and the fourth flat torquing surface 40, and pivot-engaging means 36 for engaging the second pivoting means 22 for axially pivoting the second jaw element 14 about a second axis of rotation, which substantially parallel to the first axis of rotation of the first pivoting means for the jaw element 12.

The pair of jaws 12 and 14 are each designed with an internal 120° angle to accommodate a Hex shape object 24 with positive location for a non slip action. In this regard, the first jaw element 12 has a first, flat torquing surface 30 and a second, flat torquing surface 32 forming a substantially 120° angle at the intersection of the flat torquing surface 30 and the flat torquing surface 32. The wrench 10 further includes spring means for exerting a closing force to urge the first jaw element and the second jaw element toward each other, to complete the functional operation of the wrench. In the illustrated embodiment 10 of FIG. 1, the return spring 18 exerts a closure force on the pair of jaws 12, 14 to surface contact with corresponding Hex object surfaces and provides an automatic snapping on the object 24 when the handle 28 swings in back stroke (in the direction of arrow 26) for ratcheting action.

The pair of jaws 12, 14 move linearly against each other under the influence of a guiding pin 16 which has one end anchored in jaw 12 and slides through a cylindrical bore 29 in jaw 14. The guiding pin 16 and cylindrical bore 29 serve as means for maintaining a first jaw element 12 and the second jaw element 14 in substantially parallel alignment such that upon relative separation thereof by pivoting of the first jaw element 12 about the first pivoting means 20, and concomitant pivoting of the second jaw element about the second pivoting means 22, the first flat torquing surface 30 of the first jaw element 12 is maintained substantially parallel to the fourth flat torquing surface 40 of the second jaw element and said second flat torquing surface 32 is maintained substantially parallel to said third flat torquing surface 38 to permit engagement of a hexagonally shaped screw fastener therebetween. It is noted that the jaw element 12 has a cylindrical bore 34 for engaging the pivoting pin 20 which is appropriately larger than the diameter of the pin 20, and that the jaw 14 has a cylindrical bore 36 for engaging the pin 22, which is larger than the diameter of the pin 22, for accommodating the parallel travel of the jaws 12, 14 upon opening and closure of the jaws.

As described, the handle 28 is hinged to each of the pair of jaws 12 and 14 by pins 20 and 22. The locations of the hinged position are such designed with override leverage wherein when the handle 28 is swung toward jaw 12 in the direction of arrow 30, it induces a gripping or closing force and causes the jaw to close or "squeeze" together about the hex object 24, and to exert a torquing force between the second surface of the jaw 12 and the third surface of the jaw 14.

In this regard, the first jaw element 12 and the second jaw element 14 are each pivotable about their respective first and second axes of rotation, such that an override leverage is created upon torquing a hexagonally shaped screw fastener element positioned between the first and second jaw element, which increases the closing force between the jaw elements when force is applied to the handle in a first rotational direction of arrow 30 (generally about the wrench torquing axis parallel to the first and second axes), and which decreases the closing force between the jaw elements when force is applied to its handle in the direction of arrow 26 (generally about the wrench torquing axis opposite to the first direction). To accomplish this result, the first axis and the second axis are positioned on the same side of an action line which is the perpendicular bisector of a line joining the intersection of the first and second surfaces 30, 32 and the intersection of the third and fourth surfaces 38, 40. The fourth flat torquing surface 40 may desirably be substantially in a plane which includes the second axis of pivoting.

The closing force on the object 24 between the jaws is released when handle 28 is swung in the reverse direction against the force of spring 18. On continuous forward and backward stroke action, the pair of jaws 12 and 14 alternately compress and turn the object 24, and slide on the surfaces of the Hex object, being urged by the spring force to "snap" on it on the reverse stroke, and to grip the object on the forward stroke, to cause a ratcheting action.

Figure 3:
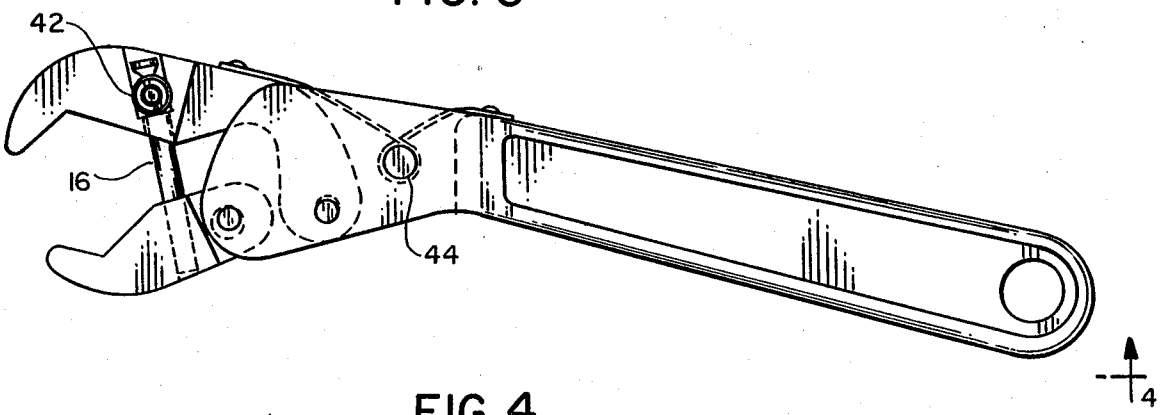
FIG. 3 is an illustration of an alternative embodiment of a self-adjustable, self-ratcheting wrench for torquing hexagonally shaped screw fastener components, having screw compression jaw locking mechanism and an alternative spring mechanism.
Figure 4:
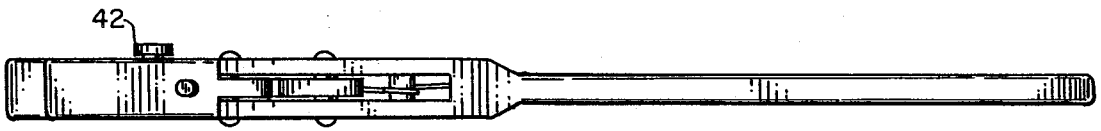
FIG. 4 is a bottom view of an alternative embodiment of a self-adjustable, self-ratcheting wrench of FIG. 3 taken in the direction of line 4—4.

It may be desirable for certain applications to lock the jaws 12, 14 in a predetermined position. As shown in FIGS. 3 and 4, which illustrates a wrench like that of FIG. 1, in which a locking mechanism for the jaw opening is provided, by tapping a hole along the sliding path of the guiding pin on the jaw 14 to accommodate a fastening means such as a thumb screw 42 to retain the guiding pin 16 at a stationary position to maintain the jaw opening at any predetermined position as desired. Also illustrated in FIG. 3 is an alternative spring closure assembly 42.

Figure 5:
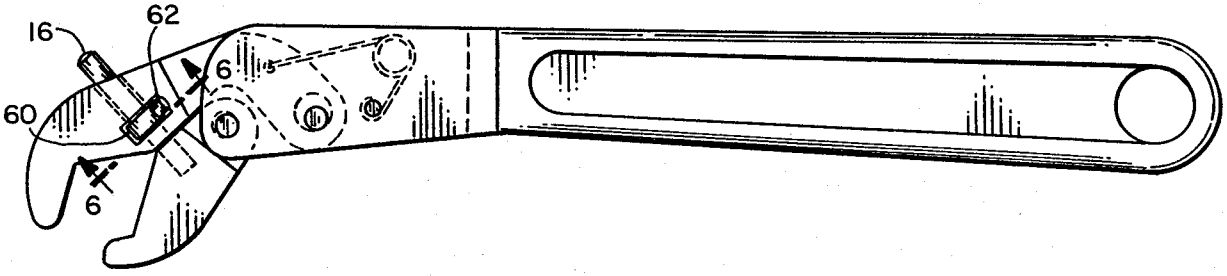
FIG. 5 is an illustration of another embodiment of a self-adjustable, self-ratcheting wrench for torquing hexagonally shaped screw fastener components, having a cam-friction jaw locking mechanism and a further embodiment of a spring closure mechanism.
Figure 6:
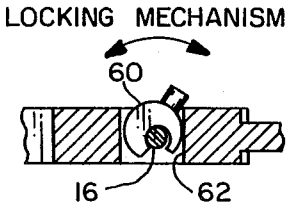

Similarly, as illustrated in FIGS. 5 and 6, a cam tightening device 60 may be utilized to immobilize the guiding pin 16 in the jaw 14 at a desired position. The locking cam is located in a slot 62 on the jaw 1 along and through the guiding pin 16. The locking cam 60 is designed in a Donut shape with an open-end. When it is pushed forward in the slot 62, the interference of the slot wall will cause its open-end to close, which induces a locking action on the pin 16, as shown in the Figure.

Figure 7:
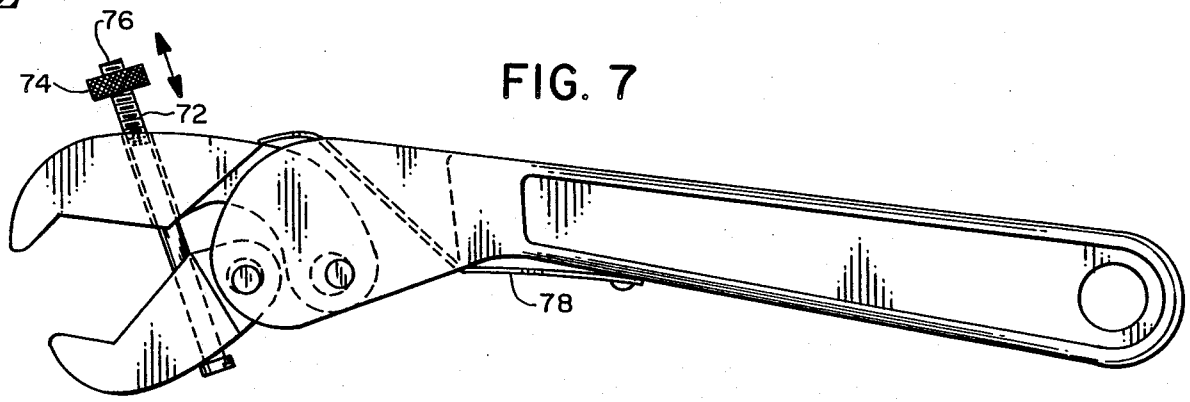
FIG. 7 is a side view of another embodiment of a self-adjustable, self-ratcheting wrench for torquing hexagonally shaped screw fastener components, having an axially threaded pin jaw locking mechanism, and a further embodiment of a spring closure mechanism.

Illustrated in FIG. 7 is another embodiment of a self-adjusting, self-ratcheting wrench for torquing a hexagonally shaped screw fastener, in which the outer-projecting length 72 of the guide pin 16 is threaded for a retaining nut 74. The threads at the distal end 76 of the guide pin 16 may be disrupted to retain the nut on the threaded length 72. When the wrench jaws 12, 14 are closed on a hexagonally-shaped screw fastener, the nut 74 may be tightened against the jaw element 14 to lock the wrench in a non-ratcheting configuration. A leaf spring element 78 which is affixed to the upper jaw 14, passes through the yoke of the handle, and which is affixed at its other end to the lower edge of the handle, urges the jaw elements 12, 14 toward each other. From the previous description, it will be appreciated that self-ratcheting, self-adjusting wrenches for torquing hexagonally shaped screw fasteners are provided which are convenient, versatile and effective.

Although the present invention has been described with respect to certain specific embodiments, it will be appreciated that various alterations and modifications will be apparent based on the present disclosure, which are within the scope of the following claims.

What is claimed is:

1. A self-ratcheting, self-adjusting wrench comprising a wrench handle having a distal end for torquing by a wrench user, and a proximal end having a first pivoting means for pivotally receiving a first jaw element and a second pivoting means for pivotally receiving a second jaw element, a first jaw element having a first, flat torquing surface and a second, flat torquing surface forming an internal substantially 120° angle at the intersection of said first flat torquing surface and said second flat torquing surface, first pivot-engaging means for engaging said first pivoting means of said handle for axially pivoting the first jaw element about a first axis, a second jaw element having a third flat torquing surface and a fourth flat torquing surface forming an internal substantially 120° angle at the intersection of said third flat torquing surface and said fourth flat torquing surface, and second pivot-engaging means for engaging said second pivoting means for axially pivoting the second jaw element about a second axis which is substantially parallel to said first axis, guiding pin means for maintaining said first jaw element and said second jaw element in substantially parallel alignment such that upon relative separation thereof by pivoting of the first jaw element about said first pivoting means, and concomitant pivoting of said second jaw element about said second pivoting means, said first flat torquing surface of the first jaw element is maintained substantially parallel to the fourth flat torquing surface of the second jaw element and said second flat torquing surface is maintained substantially parallel to said third flat torquing surface to permit engagement of a hexagonally shaped screw fastener therebetween, said guiding pin means comprising a guiding pin which has one end anchored into one of said jaw elements and which slides along a guiding hole or slot in the other of said jaw elements wherein said first and second axes are located on the same side of an action line which is the perpendicular bisector of a line joining the intersection of the first and second surfaces and the intersection of the third and fourth surfaces to create an override leverage to increase or decrease the closing force between the jaws when force is applied to the handle, and spring means for exerting a closing force to urge the first jaw element and the second jaw element toward each other, wherein said first jaw element and said second jaw element are guided to move linearly in parallel relation to each other by means of said guiding pin which has one end anchored into one said jaw elements and slides along through a guiding hole or slot in the other of said jaw elements, and wherein said jaw elements are hinged at said first and second axes.

2. A self-ratcheting, self-adjusting wrench in accordance with claim 1 wherein said first pivot-engaging means is an oversized cylindrical bore in said first jaw element wherein said second pivot-engaging means is an oversized cylindrical bore in said second jaw element, and further comprising locking means for releasably fastening said guiding pin of said jaw elements at a predetermined position to prevent sliding of the pin in said other jaw element.

* * * * *